US005857359A

United States Patent [19]

Matsuda et al.

[11] Patent Number: 5,857,359

[45] Date of Patent: Jan. 12, 1999

[54] KNIT SLIDE FASTENER

[75] Inventors: Yoshio Matsuda; Hidenobu Kato; Yoshito Ikeguchi, all of Toyama-ken, Japan

[73] Assignee: YKK Corporation, Tokyo, Japan

[21] Appl. No.: 646,990

[22] Filed: May 8, 1996

[30] Foreign Application Priority Data

May 12, 1995 [JP] Japan ..... 7-114670

[51] Int. Cl.[6] ..... D04B 21/20; D04B 21/14; A44B 19/56

[52] U.S. Cl. ..... 66/193; 66/190; 66/192; 66/195; 24/392

[58] Field of Search ..... 66/190, 192, 193, 66/195; 24/391, 392, 393

[56] References Cited

U.S. PATENT DOCUMENTS

| | | | |
|---|---|---|---|
| 3,864,946 | 2/1975 | Matsuda | 66/193 |
| 4,075,874 | 2/1978 | Heimberger | 66/195 X |
| 4,137,733 | 2/1979 | Heimberger | 66/195 |
| 4,442,685 | 4/1984 | Matsuda | 66/193 |
| 4,543,805 | 10/1985 | Yoshida et al. | 66/193 X |
| 5,035,125 | 7/1991 | Fröhlich et al. | 66/193 |
| 5,502,985 | 4/1996 | Matsuda et al. | 66/193 |
| 5,540,064 | 7/1996 | Matsuda et al. | 66/193 |

FOREIGN PATENT DOCUMENTS

| | | |
|---|---|---|
| 0 688 513 A2 | 12/1995 | European Pat. Off. . |
| 2 352 087 | 12/1977 | France . |
| 2 065 225 | 2/1973 | Germany . |
| 38-11673 | 7/1963 | Japan . |

*Primary Examiner*—John J. Calvert
*Attorney, Agent, or Firm*—Hill, Steadman & Simpson

[57] ABSTRACT

In a knit slide fastener in which a continuous fastener element row is knitted in a fastener element attaching marginal portion of each of fastener tapes simultaneously with the knitting of the fastener tape, the fastener element attaching marginal portion includes a plurality of parallel binding chain stitch yarns extending longitudinally of the marginal portion for holding the fastener element row to the marginal portion. One of the binding chain stitch yarns, which is adjacent to coupling heads of fastener elements, is larger in size than the remaining binding stitch yarns.

7 Claims, 11 Drawing Sheets

KNIT SLIDE FASTENER

BACKGROUND OF THE INVENTION

1. Field of the Invention

This invention relates to a knit slide fastener in which a coiled fastener element row is continuously knitted in a fastener element attaching marginal portion longitudinal on warp-knit slide fastener tapes simultaneously with the knitting of the slide fastener tape, and more particularly to a knit slide fastener having a fastener element attaching structure that can prevent coupled fastener element rows from any accidental split due to a large bending force and thrusting force exerted on the slide fastener.

2. Description of the Related Art

In one type of conventional knit slide fastener, as disclosed in, for example, Japanese Patent Publication No. Sho 38-11673, each of fastener tapes is knitted of chain stitch yarns and laid-in weft threads, and a fastener element row of a coiled nylon monofilament is knitted in the chain stitches of the fastener tape simultaneously with the knitting of the fastener tape. In another type of conventional knit slide fastener, as disclosed in, for example, U.S. Pat. No. 5,035,125, each of fastener tapes is knit of chain stitch yarns and laid-in weft threads, and a fastener element row of a plastic monofilament is knitted in a longitudinal marginal portion of the tape simultaneously with the knitting of the fastener tape in such a manner that the laid-in weft threads are interlaced with the wales of chain stitches extending over upper legs of fastener elements so as to press the upper legs toward the tape and also with the wale of chain stitches extending over lower legs of the fastener elements so as to press the lower legs against the tape.

With the first-named type knit slide fastener, since the fastener elements are held by sinker loops of chain stitch yarns of the ground structure of the fastener tape, dimensional stability cannot be achieved due to the longitudinal expansion and shrinkage of the chain stitches and hence smooth coupling of the fastener elements cannot be realized. With the second-named type knit slide fastener, in which the laid-in weft thread projecting into the longitudinal marginal portion of the fastener tape is interlaced with the needle loops of the chain stitch yarns, since the needle loop rows of the two binding chain stitch yarns extending over the fastener element row are arranged merely in parallel in such a manner that the individual needle loops are successively arranged in each binding chain stitch yarn, the longitudinal marginal portion of the fastener tape tends to expand and shrink so that firm attaching of the fastener element row cannot be achieved. And since the needle loops of the parallel binding chain stitch yarns tend to be displaced sideways, it is impossible to attach the fastener element row in a stable posture so that smooth coupling of the fastener elements cannot be realized, thus causing the coupled fastener element rows to accidentally split during using.

Further, in the knit slide fastener disclosed in U.S. Pat. No. 5,035,125, the binding yarns are larger in size than the knitting yarns of the ground structure of the fastener tape. In either of the first- and second-named conventional knit slide fasteners, all the yarns for binding chain stitches have the same size and are merely knit in parallel chain stitches. Therefore adjacent binding chain stitch yarns tend to move on the leg of the fastener element. Particularly when a thrusting force is exerted perpendicularly on the fastener surface of the slide fastener or a force so as to separate the fastener tapes apart is exerted on the slide fastener, the coupling heads of the opposed fastener element rows are pulled by each other to project a further extent from the marginal portions of the fastener tapes so that the coupled fastener element rows tend to split apart.

SUMMARY OF THE INVENTION

It is therefore an object of this invention to provide a high-quality knit slide fastener in which a pair of fastener element rows is attached to opposed longitudinal marginal portions of a pair of fastener tapes firmly with dimensional stableness, keeping a uniform attached posture of the individual fastener elements and hence making the coupled fastener element rows free from any accidental split.

In order to accomplish the above object, according to a first aspect of this invention, there is provided a knit slide fastener comprising: a pair of warp-knit fastener tapes each composed of a plurality of knitting yarns knitted in a warp-knit ground structure having a fastener element attaching marginal portion; a pair of continuous fastener element rows each knit in the fastener element attaching marginal portion simultaneously with the knitting of the respective fastener tape; and a plurality of first binding chain stitch yarns extending longitudinally of each fastener element attaching marginal portion and binding each continuous fastener element row to each fastener element attaching marginal portion, one of the first binding chain stitch yarns, which is situated toward coupling heads of fastener elements of the corresponding continuous fastener element row, being larger in size than the remaining binding chain stitch yarns.

Preferably, all of the first binding chain stitch yarns are larger in size than the knitting yarns of the ground structure. Further, one of the knitting yarns of the ground structure, which has a knitting pattern of chain stitches adjacent to connecting portions of the fastener elements of the corresponding continuous fastener element row, is larger in size than the remaining knitting yarns of the ground structure and smaller in size than the one first binding chain stitch yarn. Further, an outermost one of the knitting yarns of the ground structure, which has a knitting pattern of chain stitches adjacent to the coupling heads of the fastener elements of the corresponding continuous fastener element row, is larger in size than the remaining knitting yarns of ground structure and smaller in size than the larger first binding chain stitch yarn.

According to a second aspect of the invention, the knit slide fastener further may comprise a binding tricot stitch yarn knit in each fastener element attaching marginal portion and anchoring each fastener element row to the corresponding fastener element attaching marginal portion. Each of needle loops of the binding yarns extends over an upper leg of each fastener element so as to press the upper leg toward the fastener element attaching marginal portion. Alternatively, the binding tricot stitch yarn may be replaced by a second binding chain stitch yarn knit in along a wale formed of chain stitches of the larger binding chain stitch yarn.

With one arrangement in which at least one of the binding chain stitch yarns, which is adjacent to the coupling heads of fastener elements of the fastener element row, is larger in size than the remaining binding chain stitch yarns and in which the individual upper legs are pressed toward the fastener tape by the successive needle loops of the binding chain stitch yarn while the upper and lower legs are tightened firmly by the sinker loops of the binding chain stitch yarn, it is possible to increase both the tightening force and the area of contact of the binding yarn with the fastener elements, thus securing the fastener elements to the fastener tape firmly with the upper and lower legs in a more stabilized attached posture. Thus the binding chain stitch yarn is free from any displacement longitudinally of the leg, and the coupled fastener element rows are prevented from any accidental split even when a firm bending force or a thrusting force is exerted on the fastener surface of the slide fastener or when a lateral pulling force is exerted on the slide fastener. Using large-size heat-shrinking yarns for the binding chain stitch yarns and the tricot stitch yarn, it is possible to tighten the yarns as they are shrunk by heat setting after completing the slide fastener, increasing the dimentional stability and the attaching strength of the fastener elements.

With another arrangement in which the chain stitch yarn of the ground structure, which is adjacent to the connecting portions of the fastener elements, is larger in size than the remaining chain stitch yarns and the tricot stitch yarns of the ground structure, a slider can be moved smoothly along the opposed fastener element rows, facilitating closing and opening the slide fastener. With still another arrangement in which the outermost knitting yarn of the ground structure, which is adjacent to the coupling heads of the fastener elements, is larger in size than the remaining knitting yarns of the ground structure, it is possible to make the outer edge of the fastener element attaching marginal portion of the fastener tape substantially equivalent to the other part of the ground structure so that the confronting outer edges of the opposed fastener element marginal portions interfere with each other even when a large thrusting force is exerted on the slide fastener, thus preventing the coupled fastener element rows from being accidentally split apart.

DETAILED DESCRIPTION OF THE DRAWINGS

Various embodiments of this invention will now be described with reference to the accompanying drawings.

Figure 1:
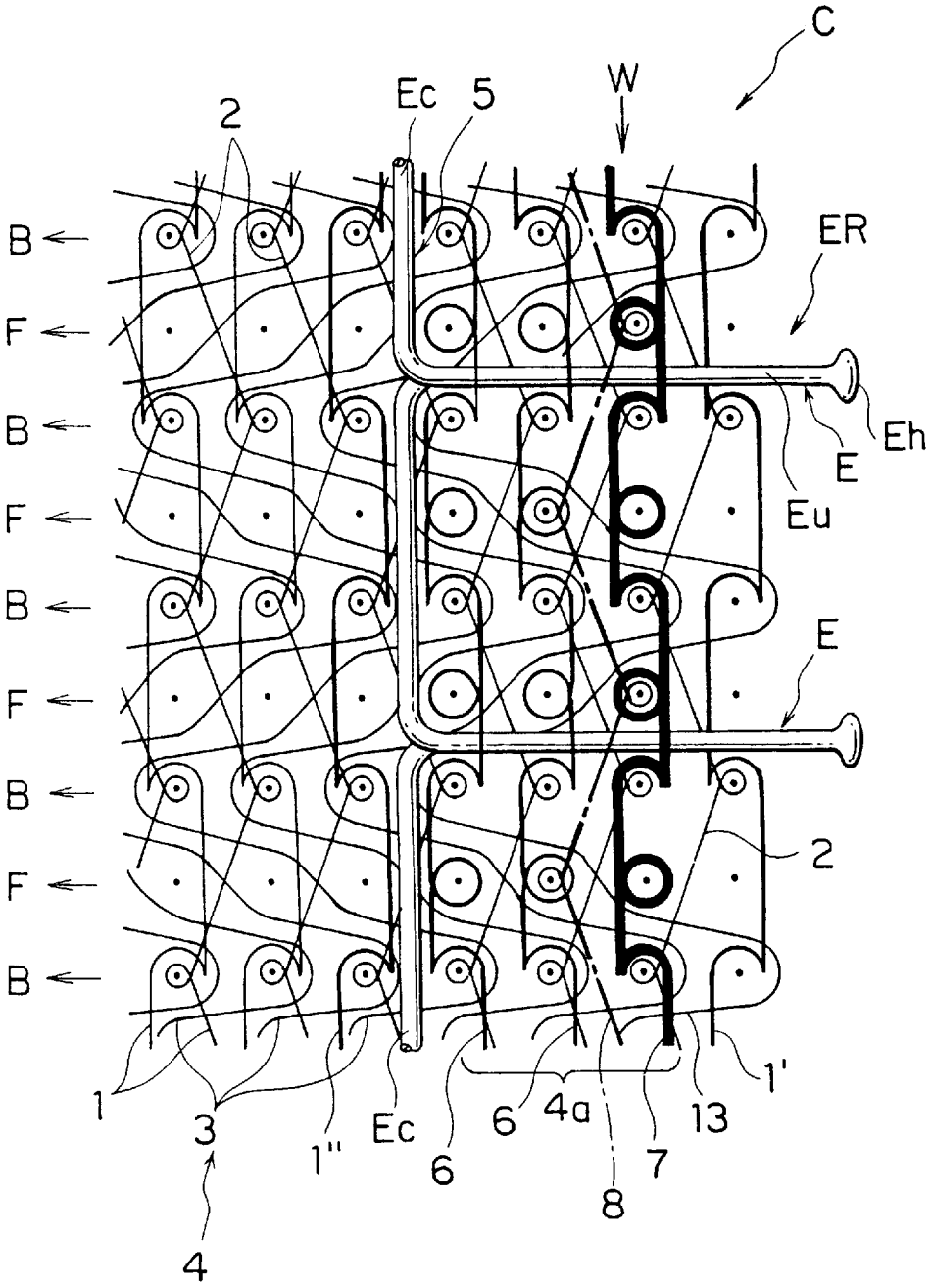
FIG. 1 is a diagram showing a knit structure of a knit slide fastener according to a first embodiment of this invention.
Figure 2:
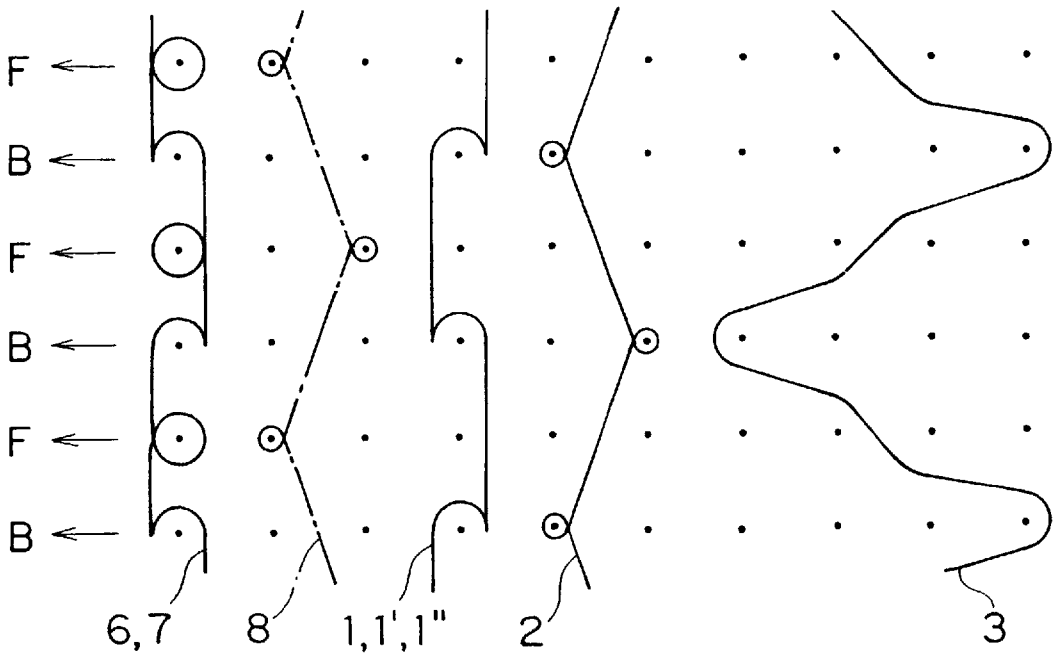
FIG. 2 is a diagram showing knitting patterns of individual yarns used in the knit slide fastener of the first embodiment.
Figure 3:
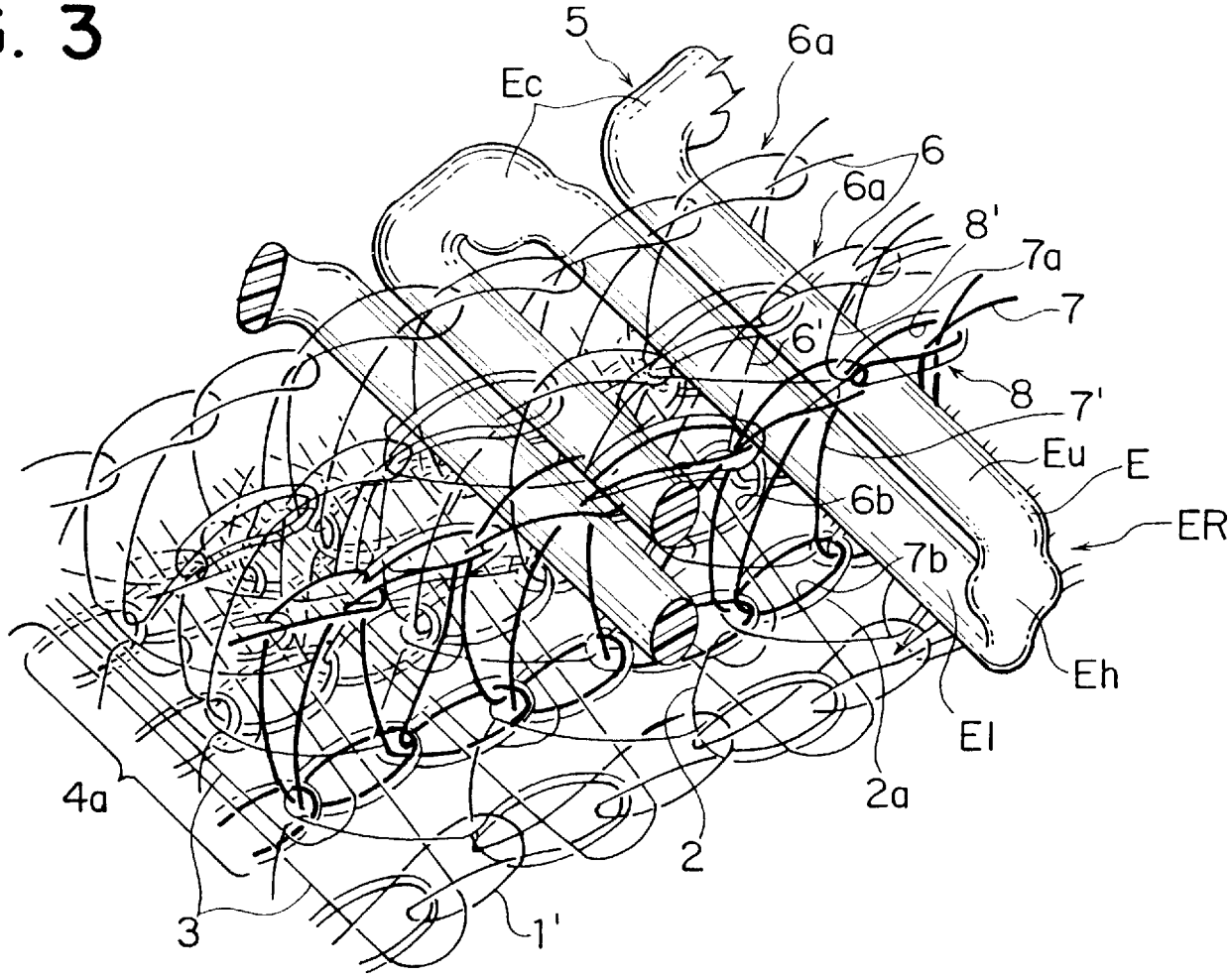
FIG. 3 is a fragmentary perspective view schematically showing the manner in which a fastener element row is attached to the corresponding fastener tape of the knit slide fastener of the first embodiment.
Figure 4:
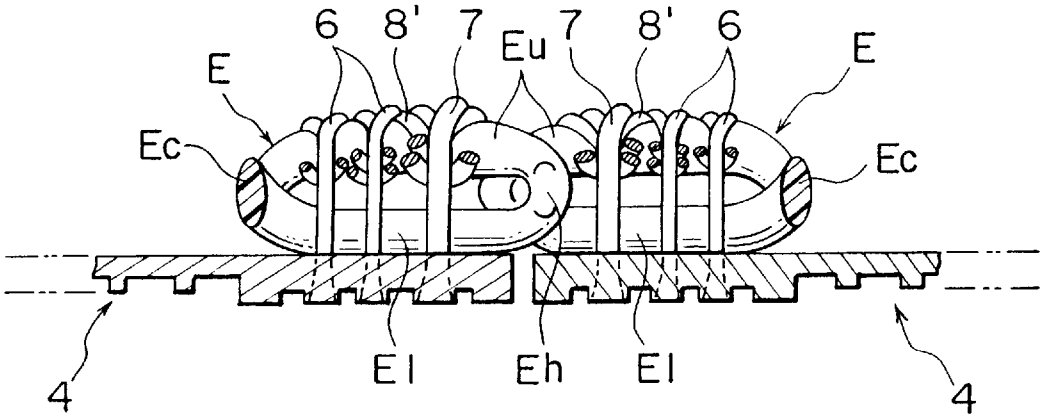
FIG. 4 is a fragmentary transverse cross-sectional view the posture in which fastener elements are mounted on opposed fastener tapes of the knit slide fastener of the first embodiment.
Figure 5:
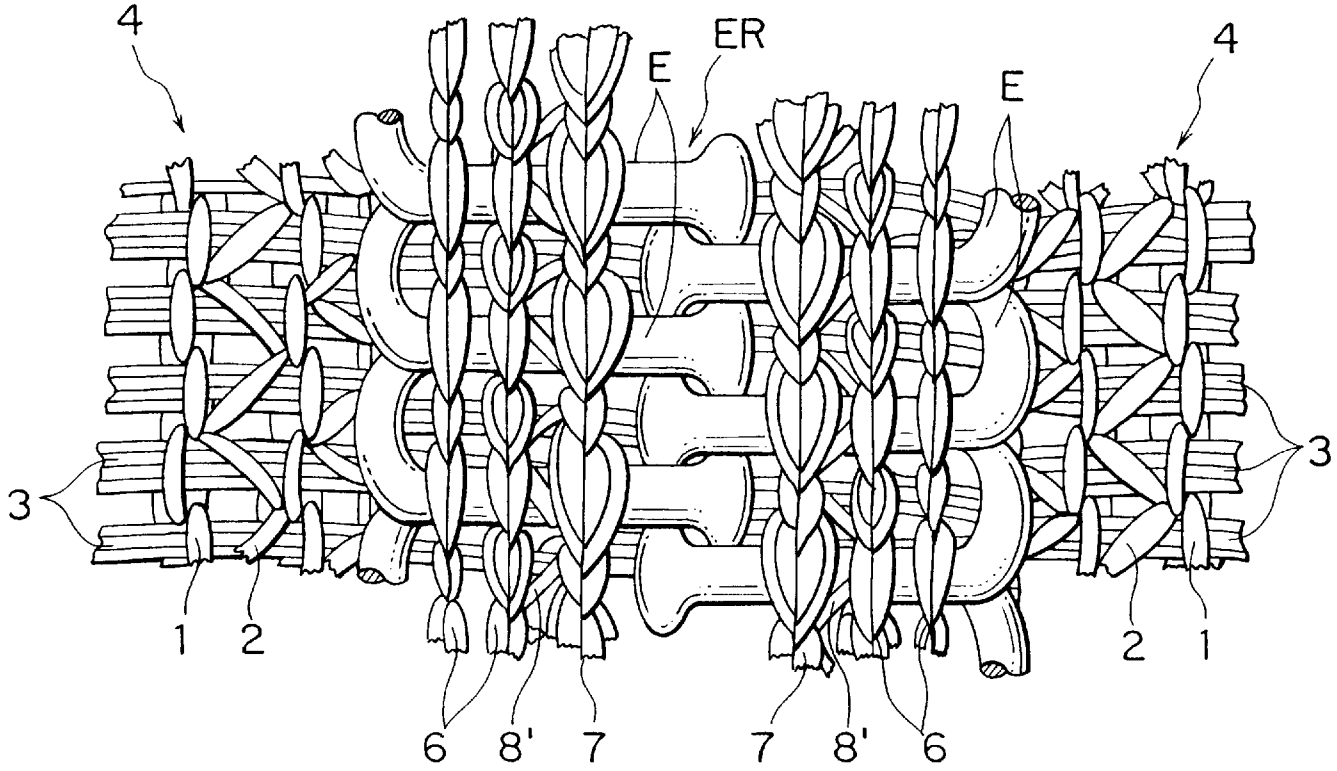
FIG. 5 is a fragmentary plan view showing the knit slide fastener of the first embodiment.

FIG. 1 is a diagram showing a knit structure of a knit slide fastener according to a first embodiment of the invention. FIG. 2 is a diagram showing the lapping movements of individual knitting yarns used in the knit slide fastener of the first embodiment. FIGS. 3, 4 and 5 show the manner in which a continuous fastener element row is attached to the corresponding fastener tape of the knit slide fastener.

The knit slide fastener (hereinafter called the slide fastener) is knitted on a warp-knitting machine, such as a double-raschel knitting machine, having two rows of needle beds. As shown in FIGS. 1 and 2, the slide fastener has a warp-knit ground structure composed of a number of chain stitch yarns 1 each having a knitting pattern of 1-0/0-0/0-1/1-1, a number of tricot stitch yarns 2 each having a knitting pattern of 1-2/1-1/1-0/1-1, and a number of laid-in weft threads 3 laid in a fastener tape 4 across four wales W in a zigzag pattern of 0-0/2-2/4-4/2-2. Three wales W of a longitudinal edge of the fastener tape 4 constitute a fastener element attaching marginal portion 4*a*, in which a monofilament 5 of synthetic resin such as nylon or polyester, which is previously flattened and constitutes a coiled fastener element row ER, is knitted simultaneously with the knitting of the fastener tape 4. The monofilament 5 reciprocates transversly with changing courses C across four wales W in such a manner that, as shown in FIGS. 1 and 3, upper and lower legs Eu, El of each fastener element E is pressed by anchoring chain stitch yarns 6, 7, each of which has a knitting pattern of 0-1/1-0/1-0/0-1, in three wales W exclusive of an outermost wale W of the ground structure.

In FIG. 1, reference characters B, F represent back needles and front needles, respectively, for alternate cources C; the front needles F form stitches of knitting yarns over and across the fastener element row ER. Specifically, a preceding needle loop 6*a*, 7*a* of each of the binding chain stitch yarns 6, 7 on one side of a double chain stitch structure is formed over the fastener element row ER and is interlooped with a succeeding needle loop 6*a*, 7*a* of the same binding chain stitch yarns 6, 7, thus forming a succession of chain stitches longitudinally of the fastener element row ER. Meanwhile the back needles B knit the fastener element attaching marginal portion 4*a* and the remaining part of the fastener tape; the fastener tape 4 is knit of the chain stitch yarns 1, the tricot stitch yarns 2 and the laid-in weft threads 3, all of the ground structure, as well as the outermost chain stitch yarn 1' of the fastener element attaching marginal portion 4*a*. On the other side of the double chain stitch structure, a preceding needle loop 6*b*, 7*b* of each of the binding chain stitch yarns 6, 7 is formed under the fastener element row ER and is interlaced with a succeeding needle loop 2*a* of the tricot stitch yarn 2 of the ground structure of the fastener tape 4, realizing a closely knit structure.

In FIG. 3, for a better understanding, the laid-in weft threads 3 are shown merely in a single thin line in each course, the remaining knitting yarns 1, 2 of the ground structure also are shown in thin lines, and stitches, such as needle loops, are shown as slackened. Practically, the size of each knitting yarn is selected as desired, considering the required function of the slide fastener, and the stitches are closely tightened. In the first embodiment, as shown in FIGS. 1 and 3, the upper and lower legs Eu, El of each fastener element E of the coiled fastener element row ER is pressed by the needle loops 7*a* of the largest-size binding chain stitch yarn 7. Since the monofilament 5 reciprocates transversly with changing courses C, a sinker loop 6', 7' of each of the binding chain stitch yarns 6, 7 enters a space between adjacent fastener elements E of the fastener element row ER so as to press the upper and lower legs Eu, El of each fastener element E, making the fastener element row ER free from any lateral displacement on the fastener element attaching marginal portion 4*a* and hence realizing an improved slide fastener.

In this embodiment, as shown in FIGS. 1 and 3 (in phantom lines in FIG. 1), of three wales W of the binding chain stitch yarns 6, 7, the central wale W is connected with the outer wale W toward the coupling heads Eh of the fastener elements E by a binding tricot stitch yarn 8 having a knitting pattern of 0-1/1-1/1-2/2-1/1-1/1-0, with the upper legs Eu of the fastener elements E covered and held by sinker loops 8' of the binding tricot stitch yarn 8. The binding tricot stitch yarn 8 is knitted by the front needles F successively with the needle loops 6*a*, 7*a*, which are formed by the front needles F, of each binding chain stitch yarn 6, 7 of these two wales. This binding tricot stitch yarn 8 may be located on the upper side of the fastener element row as demand arises, so that it is possible to cover the upper surface of the upper leg Eu of the fastener element E and also to prevent the binding chain stitch yarns 6, 7 from being displaced sideways on the fastener elements E. Further, the binding tricot stitch yarn 8 may be knitted with all the binding chain stitch yarns 6, 7 of three wales W as demand arises.

In this embodiment, all the binding chain stitch yarns 6, 7 of three wales W of chain stitches as well as the binding tricot stitch yarn 8 are larger in size than the knitting yarns of the ground structure of the fastener tape 4 and are heat-shrinking yarns. Further, the binding chain stitch yarn 7 constituting the outer wale W toward the coupling heads Eh of the fastener element E is larger in size than the remaining binding chain stitch yarns 6 and the binding tricot stitch yarn 8.

In this embodiment, the size of the largest binding chain stitch yarns 7 is 75 d (225 d for three yarns), while the size of the remaining binding chain stitch yarns 6, the size of the binding tricot stitch yarn 8, the size of the chain stitch yarn 1", which is of chain stitch yarns 1 of the ground structure of the fastener tape 4, adjacent to the connecting portions Ec of the fastener elements E, and the size of the outermost chain stitch yarn 1', which is of chain stitch yarns 1 of the ground structure, toward the coupling heads Eh of the fastener elements E are 75 d (150 d for two yarns). The size of each of the knitting yarns, i.e. the ordinary chain stitch yarns 1, tricot stitch yarns 2 and laid-in weft threads 3, of the ground structure of the fastener tape 4 is 100 d.

Figure 12:
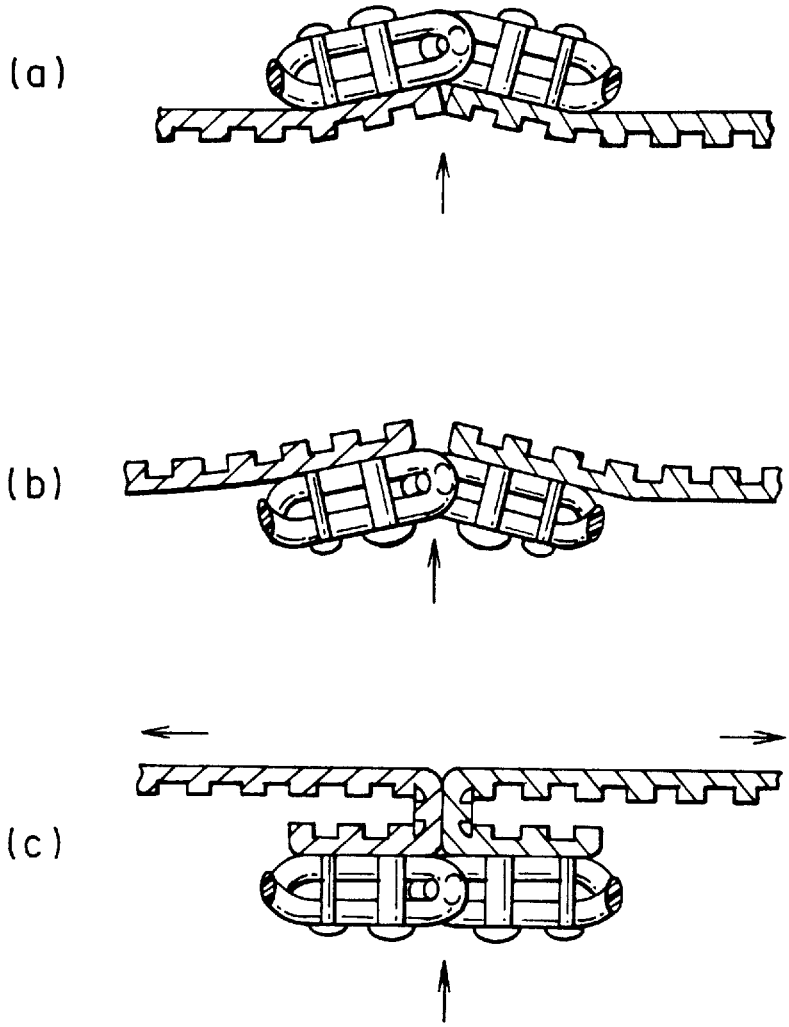
FIGS. 12(*a*), 12(*b*) and 12(*c*) are fragmentary transverse cross-sectional views of various types of knit slide fastener according to this invention, each schematically showing the knit slide fastener when a thrusting force and/or transverse pulling forces are exerted on the opposed fastener stringers.

With the arrangement in which of a plurality of binding chain stitch yarns 6, 7, one knitting yarn 7 toward the coupling heads Eh of the fastener elements E is larger in size than the remaining yarns and in which needle loops 6*a*, 7*a* of the binding chain stitch yarns 6, 7 press the upper surface of the upper leg Eu while sinker loops 6', 7' tighten the largest-size binding yarn 7 against the upper and lower legs Eu, El firmly, it is possible to increase both the tightening force and the area of contact of the binding yarn 7 with the fastener elements E, thus securing the fastener elements E to the fastener tape firmly with the upper and lower legs Eu, El in a more stabilized attached posture. Thus the binding chain stitch yarns 6, 7 are free from any displacement longitudinally of the legs Eu, El, and the coupled fastener element rows ER are prevented from any accidental split even when a firm bending force or a thrusting force is exerted on the fastener surface of the slide fastener, as shown in FIGS. 12(*a*) and 12(*b*), or when a lateral pulling force is exerted on the slide fastener, as shown in FIG. 12(*c*), no separation between fastener tapes 4 on the coupling fastener heads Eh occures, thus being possible to keep required function for concealed slide fastener.

Using large-size heat-shrinking yarns for the binding chain stitch yarns 6, 7 and the tricot stitch yarn 8, it is possible to tighten the yarns as they are shrunk by heat setting after completing the slide fastener, increasing the dimensional stability and the attaching strength of the fastener elements.

With another arrangement in which the chain stitch yarn 1" of the ground structure, which is adjacent to the connecting portions Ec of the fastener elements E, is larger in size than the remaining chain stitch yarns 1 and the tricot stitch yarn 2, a non-illustrated slider can be moved smoothly along the opposed fastener element rows ER, facilitating closing and opening the slide fastener. With still another arrangement in which the outermost knitting yarn 1' of the ground structure, which is adjacent to the coupling heads Eh of the fastener elements E, is larger in size than the remaining knitting yarns of the ground structure, it is possible to make the outer edge of the fastener element attaching marginal portion 4*a* of the fastener tape 4 substantially equivalent to the other part of the ground structure so that the confronting outer edges of the opposed fastener element marginal portions 4*a* interfere with each other even when a large thrusting force is exerted on the slide fastener, as indicated by an arrow in FIG. 2(*a*), thus preventing the coupled fastener element rows ER from being accidentally split apart.

As the synthetic resin monofilament to be used as a coiled continuous fastener element row ER, which is previously flattened at portions corresponding to coupling heads Eh and connecting portions Ec by stamping, is supplied into the warp-knitting machine between the front needles F and the back needles B. the monofilament is bent at the flattened portions into a coiled form. In the illustrated example, the fastener element row ER is a coiled type. Alternatively, the fastener element row ER may be a zigzag or meandering type, in which the monofilament has a succession of horizontal Us arranged longitudinally and adapted to be located alternately on the upper side and lower side of the fastener tape. In another alternative form, a non-stamped monofilament having a rectangular or oval cross section may be used as a continuous fastener element row.

Figure 6:
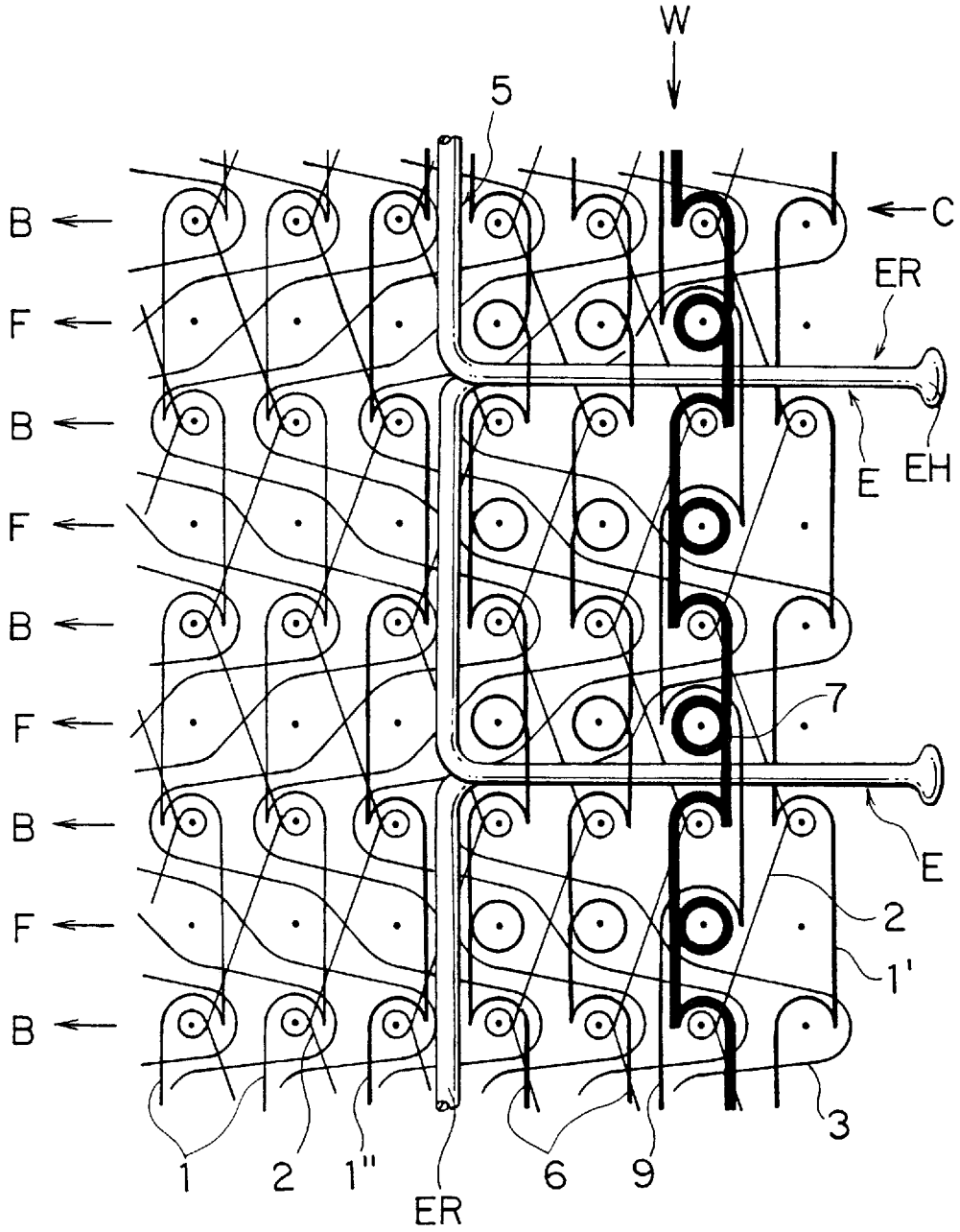
FIG. 6 is a diagram showing a knit structure of a knit slide fastener according to a second embodiment of the invention.
Figure 7:
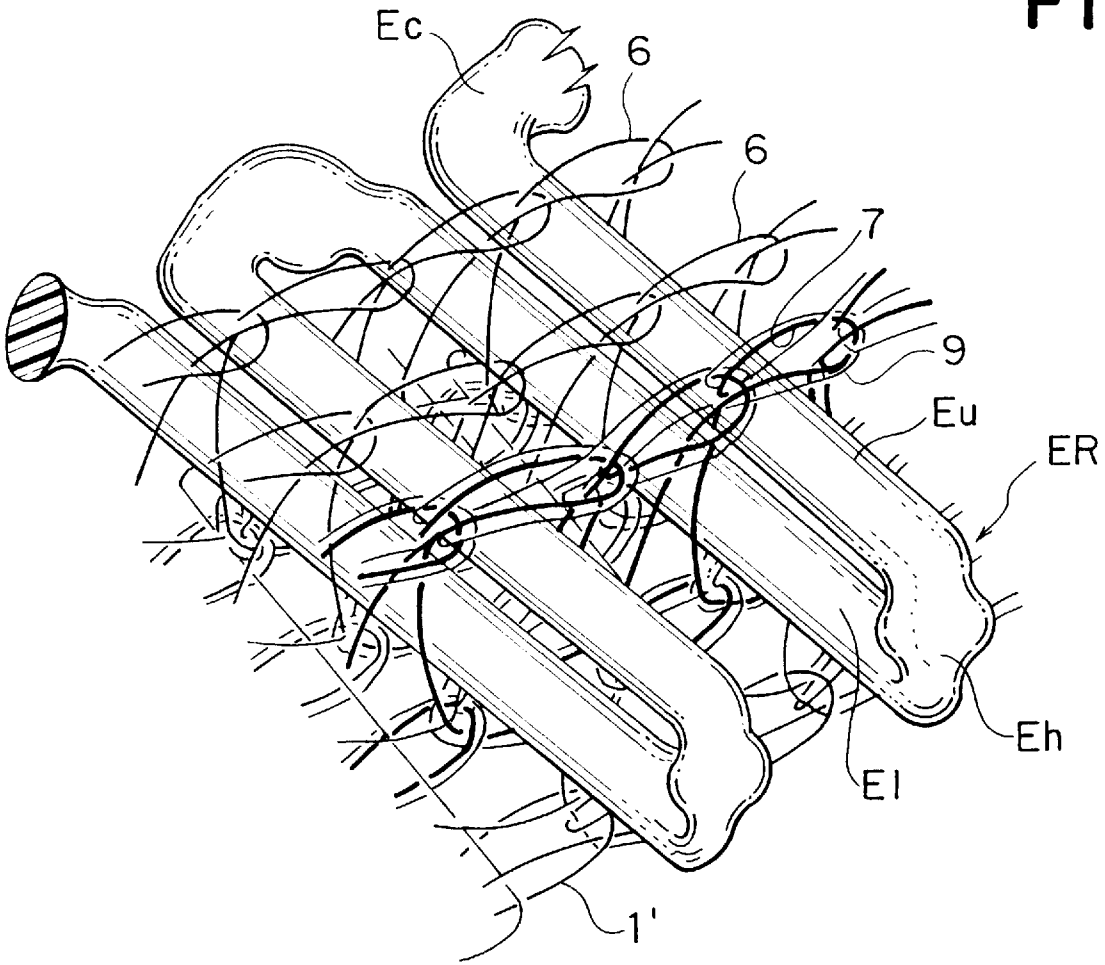
FIG. 7 is a fragmentary perspective view schematically showing the manner in which a fastener element row is attached to the corresponding fastener tape of the knit slide fastener of the second embodiment.

FIGS. 6 and 7 show a second embodiment similar to the first embodiment except that a second binding chain stitch yarn 9 having a knitting pattern of 0-1/1-1/1-0/0-0 is used for substitute for the binding tricot stitch yarn 8 of the first embodiment and has a size of 75 d (150 d for two yarns) smaller than the size of the largest binding chain stitch yarn 7. The size of every yarn may be as desired except that one binding yarn 7 toward the coupling heads Eh of the fastener elements E is set as largest. The second binding chain stitch yarn 9 and the largest binding chain stitch yarn 7 are simultaneously knitted in the same wale W by the front needles F.

Figure 8:
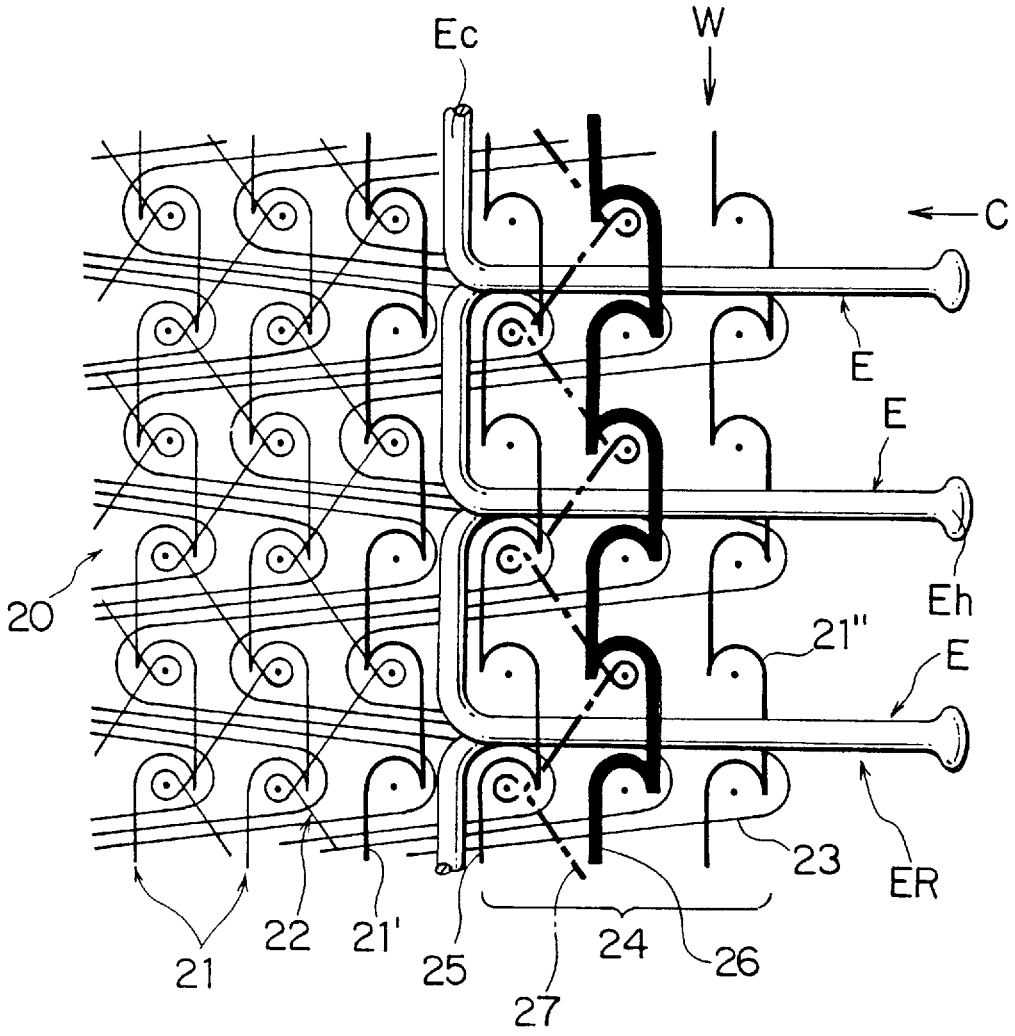
FIG. 8 is a diagram showing a knit structure of a knit slide fastener according to a third embodiment of the invention.
Figure 9:
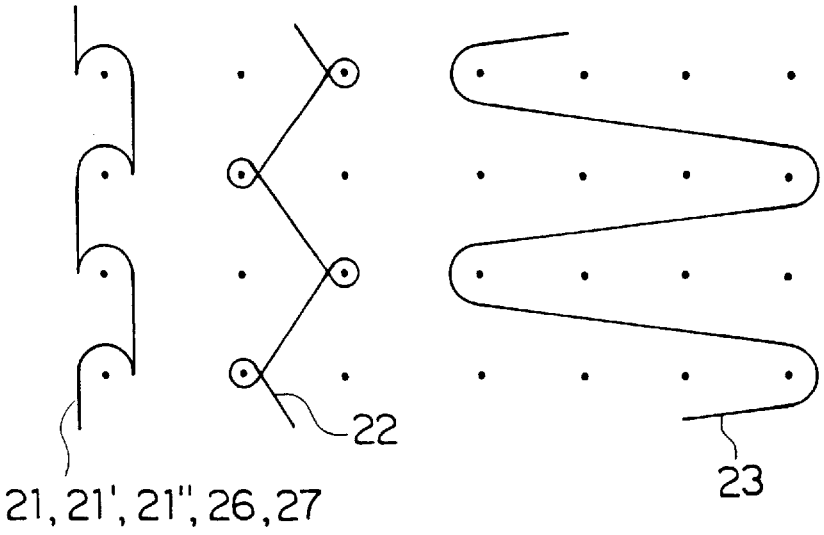
FIG. 9 is a diagram showing knitting patterns of individual yarns used in the knit slide fastener of the third embodiment.
Figure 10:
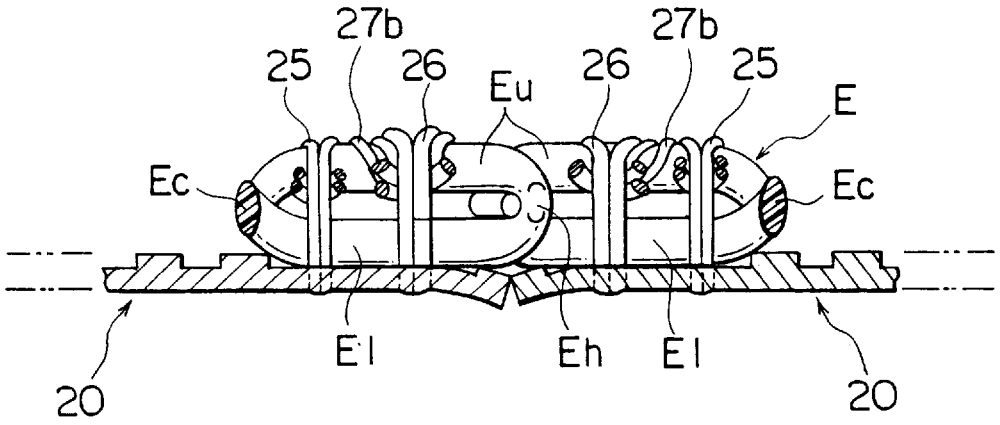
FIG. 10 is a fragmentary transverse cross-sectional view showing the posture in which fastener elements are mounted on fastener tapes of the knit slide fastener of the third embodiment.
Figure 11:
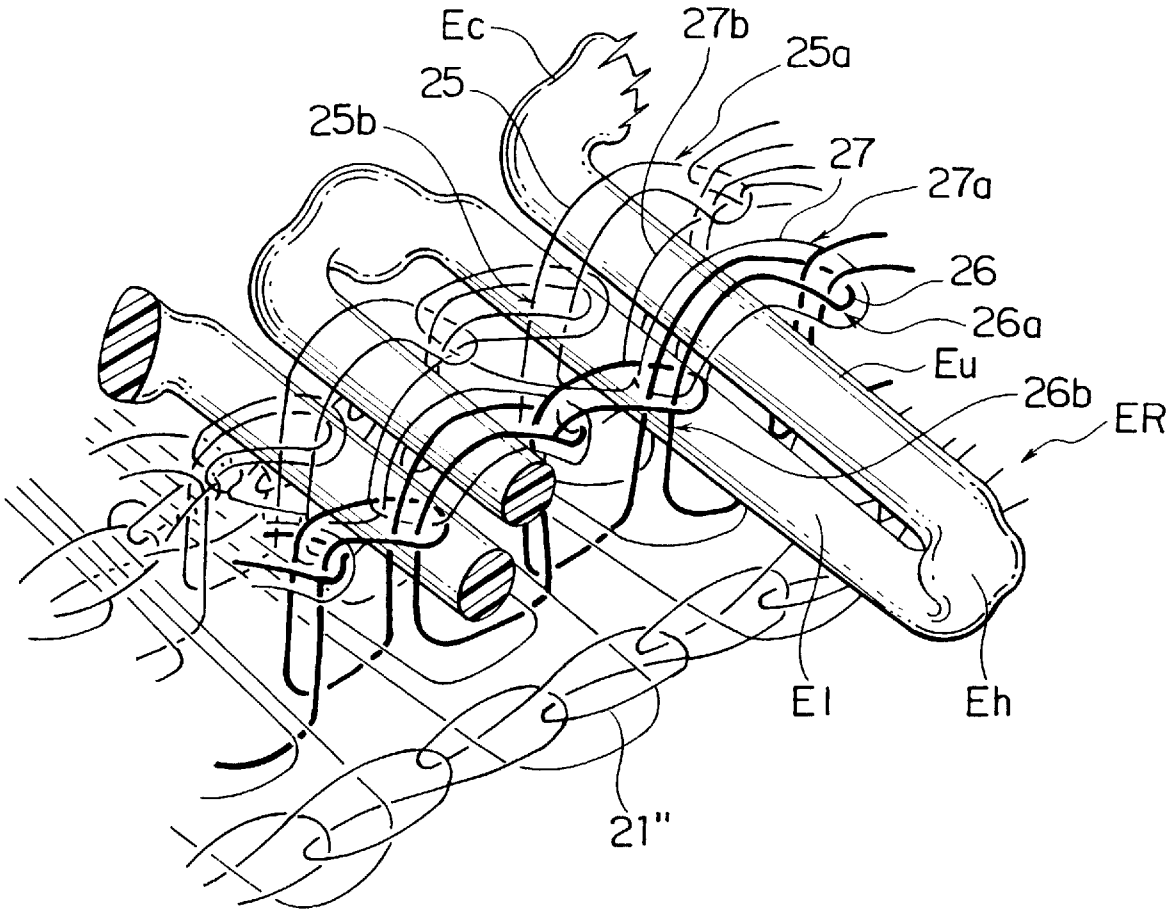
FIG. 11 is a fragmentary perspective view showing the manner in which a fastener element row is attached to the corresponding fastener tape of the knit slide fastener of the third embodiment.

FIG. 8 is a diagram showing a knit structure of a fastener element attaching marginal portion according to a third embodiment of the invention. FIG. 9 is a diagram showing the lapping movements of the individual knitting yarns of the fastener element attaching marginal portion of third embodiment. FIG. 10 is a cross-sectional view schematically showing in manner which the fastner elements are coupled. FIG. 11 is a fragmentary perspective view showing the manner in which the fastener element row is knit in the fastener element attaching marginal portion.

The slide fastener of the third embodiment is knitted on an ordinary warp-knitting machine having a single row of needle beds. The slide fastener has a warp-knit ground structure composed of a number of chain stitch yarns 21 each having a knitting pattern of 1-0/0-1, a number of tricot stitch yarns 22 each having a knitting pattern of 1-2/1-0, and a number of laid-in weft threads 23 laid in a fastener tape 20 across four wales W in a zigzag pattern of 0-0/4-4. Alternatively, the laid-in weft threads 23 may reciprocates transversly with changing courses C across all wales W of the fastener tape 20 and laid in longitudially in a zigzag pattern. Three wales W of a longitudinal edge of the fastener tape 20 constitute a fastener element attaching marginal portion 24, in which a coiled fastener element row ER in the form of a monofilament is knitted simultaneously with the knitting of the fastener tape 20. The fastener element row ER reciprocates transversly with changing courses C across three wales W in such a manner that upper and lower legs Eu, El of each fastener element E is pressed by binding chain stitch yarns 25, 26, each of which has a knitting pattern of 1-0/0-1, in two wales W exclusive of an outermost wale W of the ground structure.

In FIG. 11, for a better understanding, the chain stitch yarns 21 and tricot stitch yarns 22 of the ground structure of the fastener tape 20 are omitted, the laid-in weft threads 23 are shown merely in a single thin line in each course, the remaining knitting yarns of the ground structure also are shown in thin lines, and all stitches are shown as slackened. Practically, the size of each knitting yarn is selected as desired, considering the required function of the slide fastener, and the stitches are closely tightened. In the this embodiment, like the first embodiment, the coiled fastener element row ER to be attached to the fastener element attaching marginal portion 24, which is constituted of a monofilament of synthetic resin such as nylon or polyester, and the monofilament, which is previously flattened at portions corresponding to coupling heads Eh and connecting portions Ec by stamping, reciprocates tranversly with changing courses C and is bent at the flattened portions into a coiled form such that upper and lower legs Eu, El are arranged one over another.

The upper leg Eu of each fastener element E of the fastener element row ER is pressed from the upper side by the needle loops 25*a,* 26*a* of the binding chain stitch yarns 25, 26, which constitute two wales W, and the needle loop 27*a* of the binding tricot stitch yarn 27, and the upper and lower legs Eu, El of each fastener element E are held by inserting the sinker loops 25*b,* 26*b,* 27*b* of the binding knitting yarns 25, 26, 27 into each inter-element space of the fastener element row ER as shown in FIG. 11. Thus the fastener element row ER is secured to the fastener element attaching marginal portion 24 of the fastener tape 20. The sinker loops 26*b* of the binding chain stitch yarns 26 are interlaced with the laid-in weft threads 23 of the ground structure of the fastener element attaching marginal portion 24. The needle loops 25*a,* 26*a* of the binding chain stitch yarns 25, 26 are located on the upper side of the upper leg Eu to form a longitudinal succession of needle loops as shown in FIG. 11. The preceding needle loops 25*a,* 26*a* in every two courses are located over the upper legs Eu of each fastener element E of the coiled fastener element row ER, while succeeding needle loops 25*a,* 26*a* are located between each adjacent fastener elements E and are interlooped with the preceding needle loops 25*a,* 26*a,* as shown in FIG. 11, to pull the same preceding needle loops 25*a,* 26*a* toward the ground structure and to press the same preceding needle loops 25*a,* 26*a* in a generally inverted U shape covering from the upper leg Eu to the lower leg El of each fastener element E, thus attaching the fastener element row ER to the ground structure.

Also in this embodiment, all the binding chain stitch yarns 25, 26, which constitute two wales W, and the binding tricot stitch yarn 27 are heat-shrinking yarns larger in size than the knitting yarns of the ground structure of the fastener tape 20. The binding chain stitch yarn 26 constituting the outer one wale W, of the two wales W, adjacent to the coupling heads Eh of the fastener elements E is larger in size than the other binding chain stitch yarn 25 and the binding tricot stitch yarn 27. The size of the binding chain stitch yarn 26 is 75 d (225 d for three yarns), while the size of the remaining binding chain stitch yarn 25, the size of the binding tricot stitch yarn 27, the size of the chain stitch yarn 21', which is of chain stitch yarns 21 of the ground structure of the fastener tape 20, adjacent to the connecting portions Ec of the fastener elements E, and the size of the outermost chain stitch yarn 21", which is of chain stitch yarns 21 of the ground structure, toward the coupling heads Eh of the fastener elements E are 75 d (150 d for two yarns). The size of each of the knitting yarns, i.e. the ordinary chain stitch yarns 21, tricot stitch yarns 22 and laid-in weft threads 23, of the ground structure of the fastener tape 20 is 100 d.

Since the succeding needle loops 25*a,* 26*a* of the stitch yarns 25, 26 are pulled toward the ground structure, the upper and lower legs Eu, El is controled vertically and attached with firm stability to the ground structure. Thus it is possible to keep smooth coupling of the fastener elements. And since spaces are formed between the fastener elements, the fastener is easy to be bent longitudinally and be more flexible thus realizing easy attachment to fabric. Further, in the embodiment, the chain stitch yarn 21', which is adjacent to the connecting portion Ec of the fastener elements E, is larger in size than the chain stitch yarn 21 and the tricot yarn 22 of ground structure so that non-illustrated slider can be moved smoothly, facilitating closing and opening the slide fastener.

Since the size of the outermost chain stitch yarn 21", which is adjacent to the coupling heads Eh of the fastener elements E, of the ground structure of the fastener tape 20 is larger in size than the remaining knitting yarns of the ground structure, the outer edge of the fastener element attaching marginal portion 24 of the fastener tape 20 is substantially equivalent to the remaining part of the ground structure so that the confronting edges of the opposed fastener tapes interfere with each other to prevent the coupled fastener element rows from being accidentally split apart even when a thrusting force in the direction of an arrow is exerted on the fastener surface as shown in FIG. 12(*a*).

Alternatively, likewise in the second embodiment, a second binding chain stitch yarn may be substituted for the binding tricot stitch yarn 27 and may be knitted in the wale of the largest-size binding chain stitch yarn 26.

In each of the foregoing embodiments, a continuous fastener element row is knitted in one surface of the fastener element attaching marginal portion of the fastener tape in such a manner that coupling heads of the fastener elements are directed outwardly. Alternatively, the continuous fastener element row may be knitted in one surface of the fastener element attaching marginal portion in such a manner that the coupling heads are directed inwardly, and the resulting fastener element attaching marginal portion is folded in such a manner that the coupling heads are directed outwardly for a concealed slide fastener.

In the foregoing embodiments, the ground structure of the fastener tape is composed of chain stitch yarns, tricot stitch yarns and laid-in weft threads. Alternatively, two-needle stitch yarns may be substituted for the tricot stitch yarns, and the binding chain stitch yarns may have either closed or open stitches.

According to this invention, with the first arrangement in which at least one of the knitting yarns of binding chain stitches, which is adjacent to the coupling heads of fastener elements of the fastener element row, is larger in size than the remaining knitting yarns of binding chain stitches and in which the individual upper legs are pressed toward the fastener tape by the successive needle loops of the binding chain stitch yarns while the upper and lower legs are tightened firmly by the sinker loops of the binding chain stitch yarns, it is possible to increase both the tightening force and the area of contact of the binding yarns with the fastener elements, thus securing the fastener elements to the fastener tape firmly with the upper and lower legs in a more stabilized attached posture. Thus the binding chain stitch yarns are free from any displacement longitudinally of ther legs, and the coupled fastener element rows are prevented from any accidental split even when a firm bending force or a thrusting force is exerted on the fastener surface of the slide fastener or when a lateral pulling force is exerted on the slide fastener.

With the second arrangement in which the tricot stitch yarn or the second chain stitch yarn is interlooped with the binding chain stitch yarns on the upper surface of the continuous fastener element row, it is possible to cover the upper surface of the fastener element row by the tricot stitche and also to prevent the binding stitch yarns from being displaced sideways so that the resistance against ironing can be improved, thus making the slide fastener free from any accidental split of coupled fastener element rows even when a large external force is exerted on the slide fastener.

With the third arrangement in which the chain stitch yarn, which is adjacent to the connecting portions of the fastener elements, of the ground structure is larger in size than the remaining chain stitch yarns and the tricot yarns of the ground structure, a slider can be moved smoothly along the opposed fastener element rows, facilitating closing and opening the slide fastener. With still another arrangement in which the outermost knitting yarn of the ground structure, which is adjacent to the coupling heads of the fastener elements, is larger in size than the remaining knitting yarns of the ground structure, it is possible to make the outer edge of the fastener element attaching marginal portion of the fastener tape substantially equivalent to the other part of the ground structure so that the confronting outer edges of the opposed fastener element marginal portions interfere with each other even when a large thrusting force is exerted on the slide fastener, thus preventing the coupled fastener element rows from being accidentally split apart.

What is claimed is:

1. In a knit slide fastener comprising:

a pair of warp-knit fastener tapes each including a warp-knit ground structure and having a fastener element attaching marginal portion; a pair of continuous fastener element rows each knit in said fastener element attaching marginal portion simultaneously with the knitting of the respective fastener tape, the improvement comprising:

a plurality of first binding chain stitch yarns extending longitudinally of each said fastener element attaching marginal portion and anchoring each said continuous fastener element row to each said fastener element attaching marginal portion, one of said first binding chain stitch yarns, which is situated toward coupling heads of fastener elements of the corresponding continuous fastener element row, being larger in size than the remaining first binding chain stitch yarns.

2. The improvement according to claim 1, wherein all of said first binding chain stitch yarns are larger in size than said knitting yarns of said ground structure.

3. The improvement according to claim 1, wherein one of a plurality of knitting yarns of said warp-knit ground structure, which has a knitting pattern of chain stitches adjacent to connecting portions of said fastener elements of the corresponding continuous fastener element row, is larger in size than remaining knitting yarns of said warp-knit ground structure and smaller in size than said one first binding chain stitch yarn.

4. The improvement according to claim 1, wherein an outermost one of a plurality of knitting yarns of said warp-knit ground structure, which has a knitting pattern of chain stitches adjacent to coupling heads of said fastener elements of the corresponding continuous fastener element row, is larger in size than remaining knitting yarns of said warp-knit ground structure and smaller in size than said one first binding chain stitch yarn.

5. The improvement according to claim 1, 2, 3 or 4, further comprising a binding tricot stitch yarn knit in each said fastener element attaching marginal portion and anchoring each said fastener element row to the corresponding fastener element attaching marginal portion.

6. The improvement according to claim 3, further comprising a binding tricot stitch yarn knit in each said fastener element attaching marginal portion and anchoring each said fastener element row to the corresponding fastener element attaching marginal portion, wherein each needle loop of said binding chain stitch yarns and each binding tricot stitch yarn extends over an upper leg of each said fastener element so as to press said upper leg toward said fastener element attaching marginal portion.

7. The improvement according to claim 1, 2, 3, 4 or 6, further comprising a second binding chain stitch yarn, knit in along a wale formed of chain stitches of said one first binding chain stitch yarn.

* * * * *